US007229341B2

(12) United States Patent
Choi

(10) Patent No.: US 7,229,341 B2
(45) Date of Patent: Jun. 12, 2007

(54) METHOD AND APPARATUS FOR CHEMICAL MECHANICAL POLISHING

(75) Inventor: Jae Young Choi, Busan Metropolitan (KR)

(73) Assignee: Dongbu Electronics Co., Ltd., Seoul (KR)

( * ) Notice: Subject to any disclaimer, the term of this patent is extended or adjusted under 35 U.S.C. 154(b) by 0 days.

(21) Appl. No.: 11/320,608

(22) Filed: Dec. 30, 2005

(65) Prior Publication Data

US 2007/0077866 A1 Apr. 5, 2007

(30) Foreign Application Priority Data

Oct. 5, 2005 (KR) ..... 10-2005-0093467

(51) Int. Cl.
*B24B 1/00* (2006.01)

(52) U.S. Cl. ..... 451/41; 451/285; 451/527

(58) Field of Classification Search ..... 451/41, 451/285–289, 526–539; 438/691–693
See application file for complete search history.

(56) References Cited

U.S. PATENT DOCUMENTS

| | | | | |
|---|---|---|---|---|
| 6,159,088 | A * | 12/2000 | Nakajima | 451/527 |
| 6,729,950 | B2 * | 5/2004 | Park et al. | 451/528 |
| 2002/0068516 | A1 * | 6/2002 | Chen et al. | 451/285 |
| 2004/0058630 | A1 * | 3/2004 | Park et al. | 451/288 |

* cited by examiner

*Primary Examiner*—Dung Van Nguyen
(74) *Attorney, Agent, or Firm*—Finnegan, Henderson, Farabow, Garrett, & Henderson, L.L.P.

(57) ABSTRACT

A chemical mechanical polishing apparatus prevents scratches caused by a direct friction between a polishing pad and a wafer. The apparatus includes a polishing pad, in which grooves are regularly formed, for generating a dynamic pressure by rotation; a polishing table to which the polishing pad is adhered; a wafer provided at a predetermined interval from the polishing pad; a polishing head, on which the wafer is mounted, for driving the wafer; and a slurry supplier for providing slurry to a surface of the polishing pad.

24 Claims, 6 Drawing Sheets

FIG. 7

| P | V | v/p |
|---|---|---|
| 60 | 80 | 1.33 |
| 80 | 60 | 0.75 |
| 80 | 100 | 1.25 |
| 100 | 80 | 0.8 |
| 100 | 100 | 1 |
| 140 | 50 | 0.35 |
| 140 | 80 | 0.57 |
| 140 | 108 | 0.77 |
| 180 | 90 | 0.5 |
| 200 | 60 | 0.3 |
| 200 | 100 | 0.5 |

METHOD AND APPARATUS FOR CHEMICAL MECHANICAL POLISHING

This application claims the benefit of the Korean Patent Application No. P2005-0093467, filed on Oct. 5, 2005, which is hereby incorporated by reference in its entirety.

BACKGROUND

1. Technical Field

The present invention relates to a chemical mechanical polishing apparatus, and more particularly, to a chemical mechanical polishing apparatus to prevent scratches caused by a direct friction between a polishing pad and a wafer.

2. Discussion of the Related Art

Recently, the number of devices integrated into one fingernail-sized semiconductor chip has approached, and in some cases exceeded, $1\times10^9$. Furthermore, the number of devices integrated into one semiconductor chip is increasing by geometrical progression. To obtain both high integration and a high speed in such devices, it is necessary to improve the development of the semiconductor chip in both structural and material aspects. The improvement in the structure of the semiconductor chip involves the increase in the number of metal layers. Also, a shallow trench isolation (STI) method is used for isolation between the devices. In such devices, the semiconductor chip is formed of materials including copper (Cu) and low-dielectric material (Low-k).

A CMP (Chemical Mechanical Polishing) process becomes increasingly important as the number of metal layers increases. Generally, a semiconductor device is formed by selectively and repeatedly performing processes of photo etching, diffusion, and metal deposition on a wafer. For formation of the semiconductor device, it is necessary to repeatedly perform the CMP process for planarization and etch-back on the wafer, that is, to obtain the easiness when forming predetermined circuit patterns on the surface of the wafer.

When performing the CMP process, in a state that the surface of the wafer is in contact with a surface of a polishing pad, a slurry in which abrasives are scattered is provided thereto, thereby generating a chemical reaction. In addition, a carrier which holds a polishing table and the wafer is relatively moved, whereby the desired layer is polished mechanically, thereby planarizing the entire surface of the semiconductor device.

Hereinafter, a chemical mechanical polishing apparatus according to the related art will be described with reference to the accompanying drawings.

FIG. 1 is a schematic view of showing a chemical mechanical polishing apparatus according to the related art. As shown in FIG. 1, a chemical mechanical polishing apparatus according to the related art is provided with a polishing table 21, a polishing head 30, a slurry supplier 50, and a pad conditioner 40.

At this time, a polishing pad 20 is adhered to an upper side of the polishing table 21. The polishing head 30 is mounted on a wafer 10 including an insulating layer or a metal layer. Then, the slurry supplier 50 is provided to supply slurry to the surface of the polishing pad 20. Also, the pad conditioner 40 grinds the polishing pad 20 in the different parts from a wafer rotation part during the polishing process.

That is, after the wafer 10 is closely adhered to the polishing table 21, the wafer 10 is rotated, and the polishing table 21 is rotated, at the same time. Thus, it is possible to perform the mechanical polishing between the wafer and the polishing pad. Then, the slurry is supplied between the wafer 10 and the polishing pad 20 through the slurry supplier 50.

As a result, the slurry reacts with the insulating or metal layer of the wafer, thereby performing the chemical polishing.

For improvement of the preciseness in planarization of the device by the CMP process, it is necessary to maintain the appropriate roughness in the surface of the polishing pad 20 being in contact with the wafer, and the entire elasticity. For this, the pad conditioner 40 controls the surface state of the polishing pad 20.

In more detail, the polishing head 30 is provided with a manifold 34, a carrier 33, a retainer ring 31, and a porous plate (not shown). At this time, air supplied from the exterior through an air hole of the manifold 34 is dispersed inside the polishing head 30. The carrier 33 corresponds to a body of the polishing head 30, wherein the carrier 33 serves as the center for connection with other parts. Also, the retainer ring 31 prevents the separation of the wafer during the process. The porous plate (not shown) includes a plurality of holes, through which the air supplied from the air holes of the manifold is applied to a membrane 32 with pressure. The membrane 32 is an elastic body for covering a portion to which the wafer is fixed. As the air is supplied through the holes of the porous plate, the wafer is pressed by the air. Thus, during the chemical mechanical polishing process, the wafer is in contact with the polishing pad under the uniform pressure.

In the chemical mechanical polishing apparatus, when the polishing table 21, on which the polishing pad 20 is adhered, is rotated at a high speed, the slurry supplier 50 uniformly provides the slurry to the surface of the polishing pad. In this state, when the wafer 10 is oscillated from one side of the polishing table 21 to the other side of the polishing table 21 by the polishing head, and is also rotated at a high speed. Accordingly, the surface of the wafer is planarized with both the chemical reaction using the slurry and the mechanical reaction using the high speed rotation. After that, the slurry, which reacts with the wafer, is discharged to the outside of the polishing pad.

In the meantime, the surface roughness of the polishing pad is changed according to the mechanical friction between the polishing pad and the wafer. Therefore, a conditioning process for grinding the surface of the polishing pad with the polishing conditioner 40 is performed at fixed periods.

During the conditioning process, the polishing pad 20, adhered on the polishing table 20, is rotated at a high speed, and the polishing conditioner 40 having a grinding means such as diamond is positioned adjacent to the polishing table 20. In this state, the polishing conditioner 40 is oscillated and is rotated at a high speed.

The polishing pad is formed of a high molecular material, for example, polyurethane. With the relative movement of the wafer and the supply of slurry, it is possible to polish the surface of wafer.

Accordingly, the characteristics of slurry and polishing pad have great effects on the CMP process. Especially, the polishing pad is in direct contact with the wafer, so the surface state of the CMP polishing pad has great effects on polishing ratio, uniformity and defective ratio.

In the meantime, the CMP process is performed to planarize an over-filled insulating layer or metal layer. For example, when forming a plug for connection between a lower line layer and an upper line layer, the metal layer is gap-filled inside a contact hole on the lower line layer exposed throughout the contact hole, and then the over-filled metal layer is removed, thereby realizing the planarization in surface of the wafer.

However, the chemical mechanical polishing apparatus according to the related art has the following disadvantages.

The CMP process is useful for the planarization of device. However, in a state that the polishing pad is in direct contact with the wafer, the mechanical polishing is performed with oscillating movement and high-speed rotation. Thus, many scratches may be formed on the surface of the wafer.

Especially, in a high-integration semiconductor device, an RC delay of lines, which are related with the minuteness of semiconductor device, is relatively larger than RC delay of transistor devices. Also, as the line resistance increases, the lines are desirably formed of copper which has great conductivity and low resistance. However, copper is softer than aluminum, which may be scratched more readily during a CMP process.

SUMMARY

Consistent with the present invention, there is provided a chemical mechanical polishing apparatus that substantially obviates one or more problems due to limitations and disadvantages of the related art.

Consistent with the present invention, there is provided a chemical mechanical polishing apparatus, in which a dynamic pressure is applied to a surface of a polishing pad, so that the polishing pad and a wafer are maintained in a semi-contact state or a floating state, thereby preventing scratches caused by a direct friction between the polishing pad and the wafer.

Consistent with the invention, as embodied and broadly described herein, a chemical mechanical polishing apparatus includes a polishing pad, in which grooves are regularly formed, for generating a dynamic pressure by rotation; a polishing table to which the polishing pad is adhered; a wafer provided at a predetermined interval from the polishing pad; a polishing head, on which the wafer is mounted, for driving the wafer; and a slurry supplier for providing slurry to a surface of the polishing pad.

In another aspect consistent with the present invention, a chemical mechanical polishing apparatus includes a polishing pad, in which grooves are regularly formed in a herringbone structure, for generating a rising dynamic pressure in the bent portion of the grooves; a polishing table to which the polishing pad is adhered; a wafer provided at a predetermined interval from the polishing pad and provided at a predetermined gap from the polishing pad by the rising dynamic pressure when rotating the polishing pad; a polishing head, on which the wafer is mounted, for driving the wafer; and a slurry supplier for providing slurry to a surface of the polishing pad.

At this time, when the polishing pad is rotated in a direction opposite to the bent direction of grooves, a rising dynamic pressure is generated in the bent portion of the grooves, thereby preventing the direct contact between the wafer and the polishing pad.

When rotating the polishing pad, the wafer is also driven by the polishing head. That is, the polishing process is performed in a state that the wafer is oscillated on the polishing table, and is also rotated at a high speed. The rotation direction of the wafer is opposite, or perpendicular, to the rotation direction of the polishing pad, so it is possible to perform the effective polishing process.

Also, the grooves of the herringbone structure have a groove width ratio of Lp/L between 0.22 and 0.5, a bent angle of β between 22° and 32°, a groove depth of D between 50 μm and 410 μm, and a vertical length of γ between 0.5 mm and 4 mm.

It is to be understood that both the foregoing general description and the following detailed description of the present invention are exemplary and explanatory and are intended to provide further explanation consistent with the invention as claimed.

BRIEF DESCRIPTION OF THE DRAWINGS

The accompanying drawings, which are included to provide a further understanding of the invention and are incorporated in and constitute a part of this application, illustrate embodiments consistent with the invention and together with the description serve to explain the principle of the invention. In the drawings:

FIG. 7 is a graph of a V/P value according to the conditions of V and P.

DETAILED DESCRIPTION

Reference will now be made in detail to the preferred embodiments consistent with the present invention, examples of which are illustrated in the accompanying drawings. Wherever possible, the same reference numbers will be used throughout the drawings to refer to the same or like parts.

Hereinafter, a chemical mechanical polishing apparatus consistent with the present invention will be described with reference to the accompanying drawings.

Figure 1:
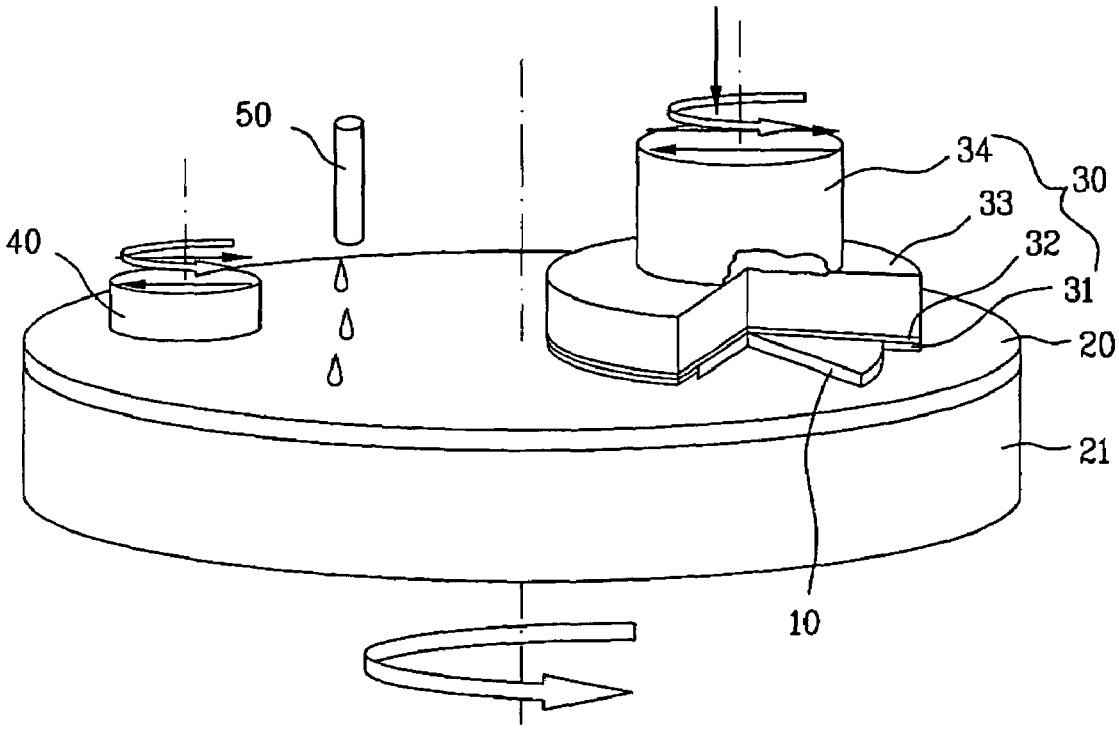
FIG. 1 Related Art
FIG. 1 is a schematic view of a chemical mechanical polishing apparatus according to the related art.
Figure 2:
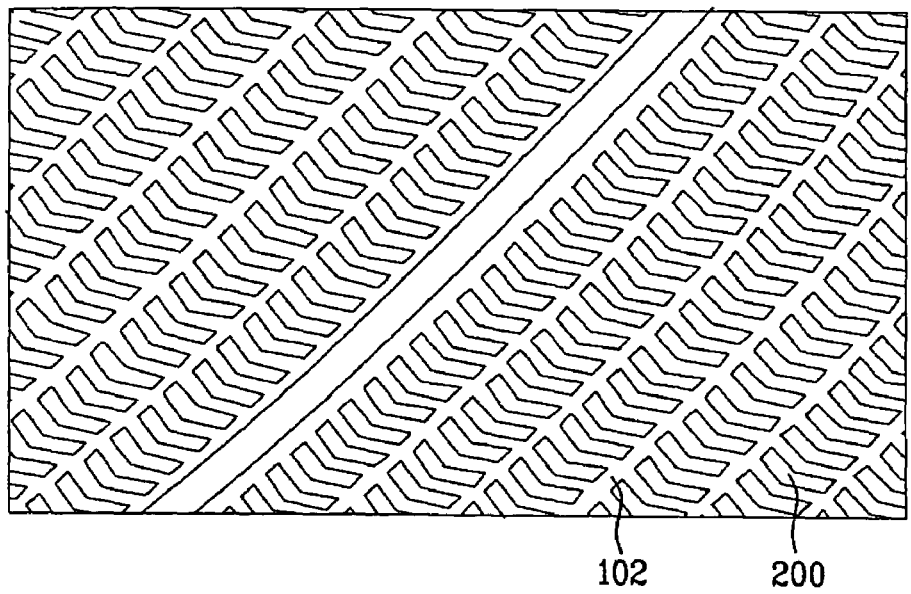
FIG. 2 is a plane view of a surface of a polishing pad consistent with the present invention.
Figure 3:
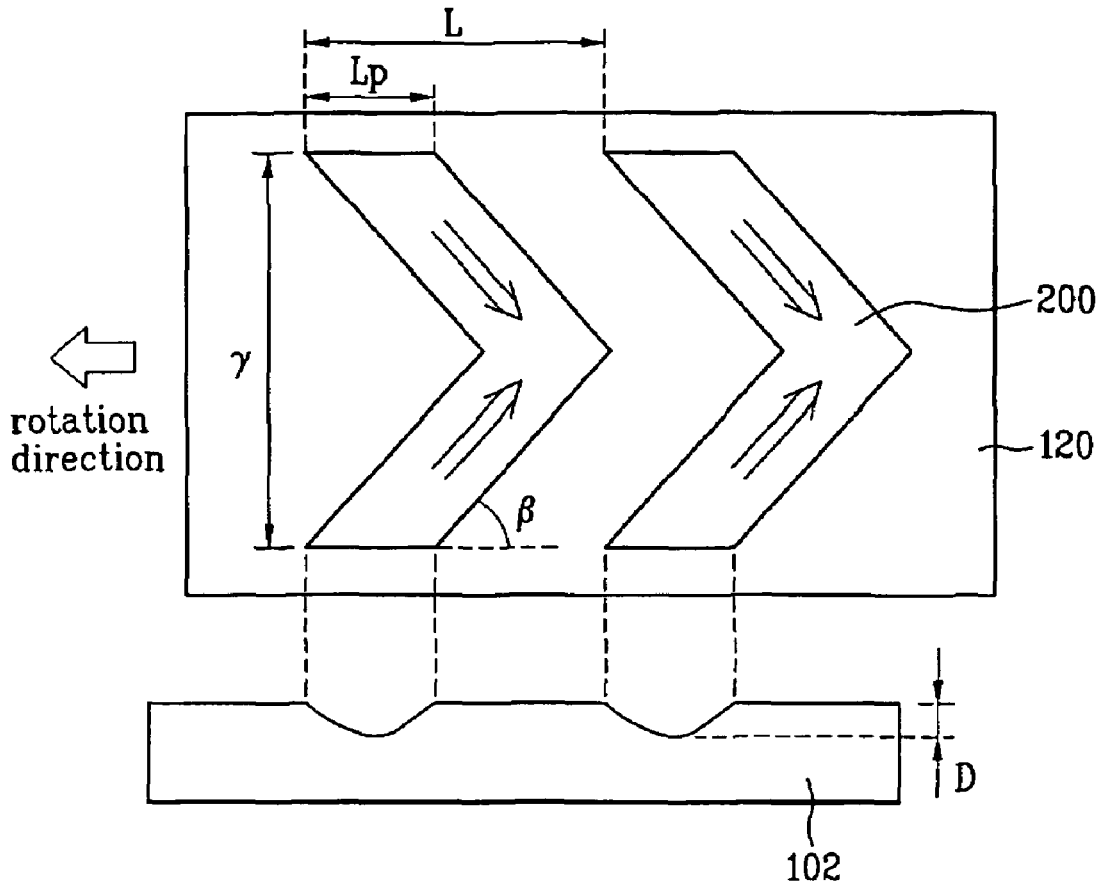
FIG. 3 is a plane and cross-sectional view of a groove shape consistent with the present invention.
Figure 4A:
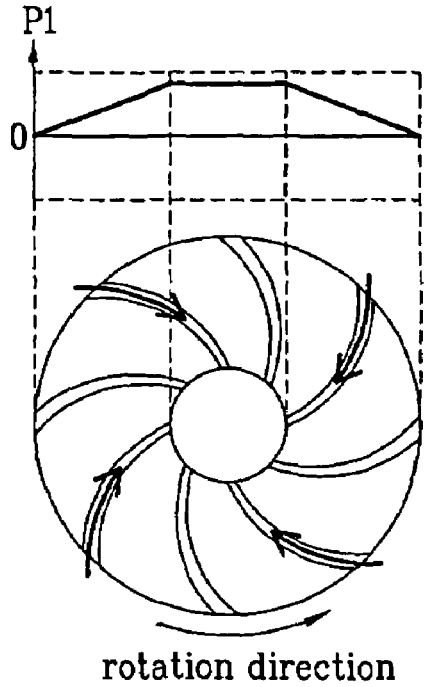
FIGS. 4A to 4C are an air-pressure distribution according to a rotation of a moving body having a predetermined shape.
Figure 4B:
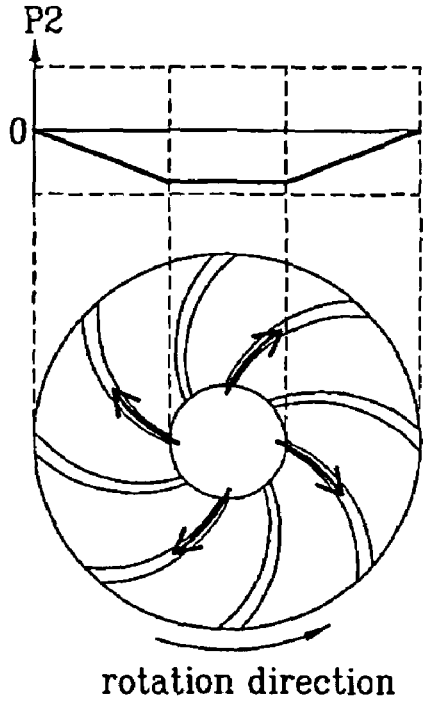
Figure 4C:
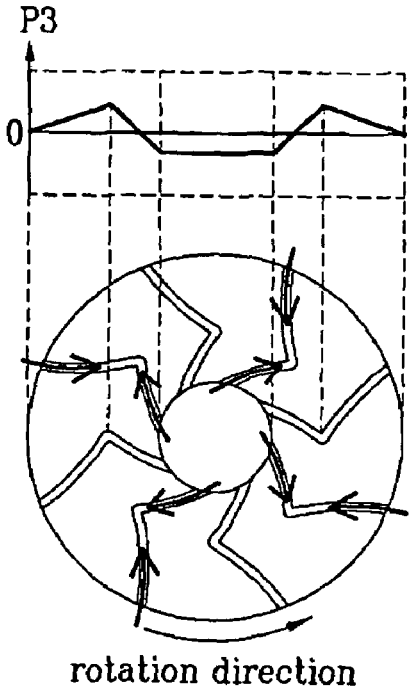

FIG. 2 is a plane view of a surface of a polishing pad according to the present invention. FIG. 3 is a plane and cross-sectional view of a groove shape according to the present invention. FIGS. 4A to 4C are an air-pressure distribution according to a rotation of a moving body having a predetermined shape.

Figure 5:
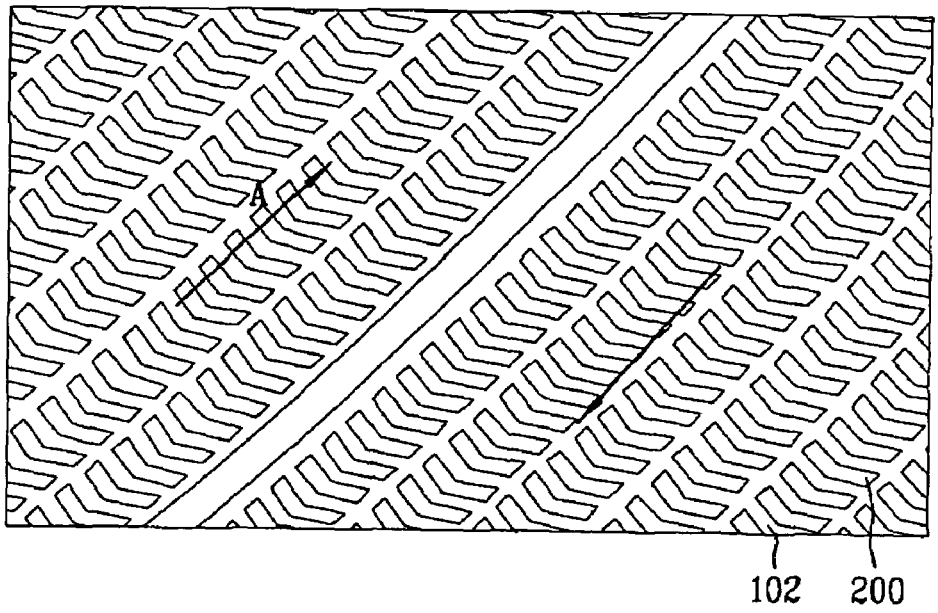
FIG. 5 is a view of a polishing pad rotated in a direction of 'A' or 'B', consistent with the present invention.
Figure 6:
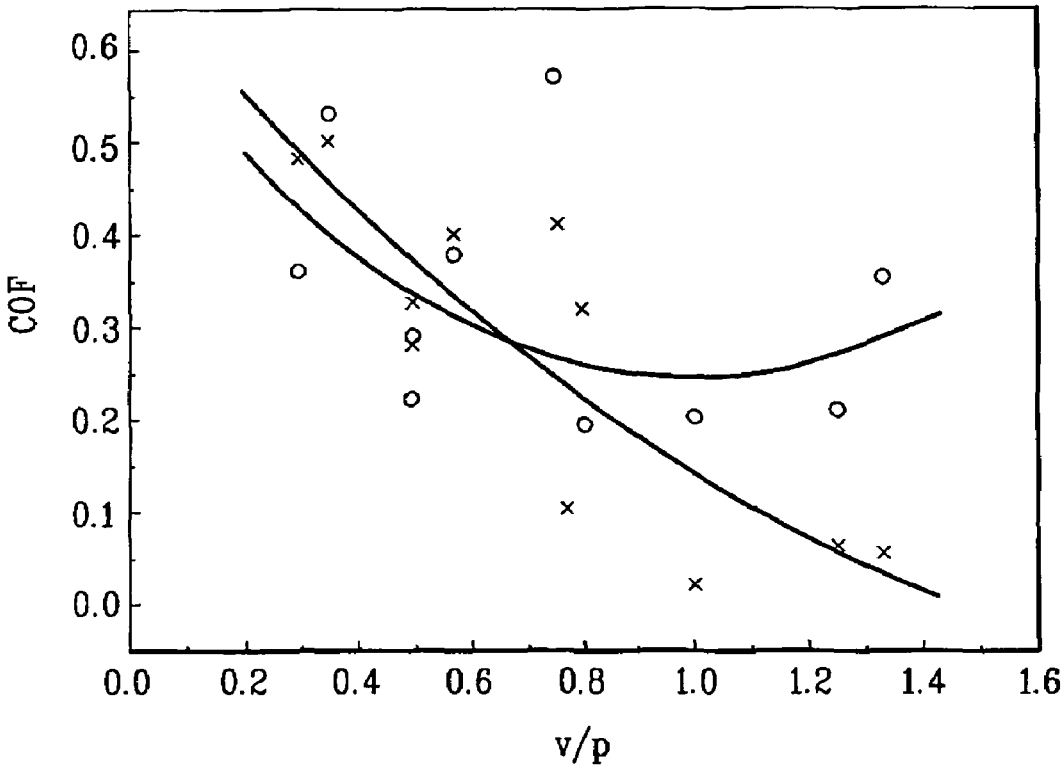
FIG. 6 is a graph of a coefficient of friction for V/P when a polishing pad is rotated in a direction of 'A' or 'B'.

FIG. 5 is a view of a polishing pad rotated in a direction of 'A' or 'B', according to the present invention. FIG. 6 is a graph of a coefficient of friction for V/P when a polishing pad is rotated in a direction of 'A' or 'B'. FIG. 7 is a graph of a V/P value according to the conditions of V and P.

A chemical mechanical polishing apparatus consistent with the present invention is provided with a polishing head, a polishing table, and a slurry supplier. At this time, a substrate, which may be a wafer, including an insulating layer or a metal layer is mounted on the polishing head. Also, a polishing pad 102, in which herringbone-shaped grooves 200 shown in FIG. 2 are arranged regularly, is adhered to the polishing table. Then, the slurry supplier supplies slurry to the surface of the polishing pad.

The polishing head, to which the wafer is adhered, moves downwardly, the wafer is closely positioned to the polishing table. Then, when the polishing head having the wafer is oscillated on the polishing table, and is also rotated at a high speed, the polishing table is relatively rotated, thereby performing a mechanical polishing between the wafer and the polishing pad.

The polishing head is comprised of a manifold, a carrier, a retainer ring, a porous plate, and a membrane. In this case, air supplied from the exterior through an air hole is dispersed inside the polishing head by the manifold. The carrier corresponds to a body of the polishing head, wherein the carrier serves as the center for connection with other parts. Also, the retainer ring prevents the separation of the wafer during the process. The porous plate includes a plurality of holes, through which the air supplied from the air holes of the manifold is applied to the membrane with pressure. The membrane is an elastic body for covering a portion to which the wafer is fixed. As the air is supplied through the holes of the porous plate, the membrane applies uniform pressure to the wafer. Thus, during the chemical mechanical polishing process, the wafer is in contact with the polishing pad under a uniform pressure.

In the meantime, the slurry including a polishing material and a chemical material is provided between the wafer and the polishing pad, whereby the slurry reacts with the insulating or metal layer of the wafer, thereby performing a chemical polishing.

In the polishing process, the grooves formed in the surface of the polishing pad may abrade due to the mechanical friction between the polishing pad and the wafer, or may be contaminated with a foreign material, thereby causing a change in the planarization ratio. Thus, a pad conditioner is additionally provided to grind the polishing pad in the different parts from a wafer rotation part during the polishing process. Thus, a conditioning process for grinding the surface of the polishing pad is performed at fixed periods, by an oscillating movement and high-speed rotation of the pad conditioner.

In a state that the metal layer inside a contact hole is gap-filled and the metal layer is over-filled to the outside of the contact hole, the chemical mechanical polishing process is performed on the wafer, thereby obtaining the planarization in the surface of the wafer by removing the over-filled metal layer. The metal layer may be formed of aluminum Al or copper Cu.

Also, the chemical mechanical polishing process is performed to planarize the coated insulating layer as well as the over-filled metal layer. The insulating layer may be formed of low-k material.

Due to the relative high rotation of the polishing table and the polishing head, a dynamic pressure is generated between the wafer and the polishing pad having the herringbone-structure grooves, thereby performing a chemical polishing decreasing the contact between the wafer and the polishing pad. That is, the polishing pad is not in direct contact with the wafer because of the dynamic pressure generated between the polishing pad and the wafer. Thus, the polishing pad may be maintained at a predetermined distance from the wafer, thereby preventing scratches caused by mechanical polishing.

In the polishing pad 102 having the herringbone-structure grooves 200, the herringbone-structure grooves 200 may be formed in the shape shown in FIG. 2, wherein a groove width ratio of Lp/L is within 0.22 to 0.5, and a bent angle of groove, β, may be between 22° and 32°. Also, a depth of groove, D, may be between 50 μm and 410 μm, and a vertical length of the herringbone-structure, γ, may correspond to 0.5 mm to 4 mm. At this time, the herringbone-structure groove is bent in a direction opposite to the rotation direction of the polishing pad.

As shown in FIG. 3, when rotating the polishing pad in a direction opposite to the bent direction of the groove, the air flows in a direction of the dual arrow, whereby a negative pressure of rising air is generated in the bent portion of the groove. According to the negative pressure, the polishing pad is not in direct contact with the wafer. That is, the polishing pad may be maintained at the predetermined distance from the wafer. In this case, the predetermined interval between the polishing pad and the wafer may be maintained during the polishing process of rotating the polishing pad and the wafer, thereby preventing scratches on the surface of the wafer.

As shown in FIG. 4A, if the moving body having spiral grooves bent toward the left direction is rotated in a counterclockwise direction, the external air flows along the grooves, and the rising air-pressure distribution P1 is generated in the center. Thus, the rising dynamic pressure is generated in the center, and the dropping dynamic pressure is generated in the periphery of the moving body, external to the moving body.

Referring to FIG. 4B, if the moving body having spiral grooves bent toward the right direction is rotated in a counterclockwise direction, the central air flows along the grooves toward the periphery, and a rising air-pressure distribution P2 is generated at the periphery. Thus, the central portion is in a vacuum state, so that a dropping dynamic pressure is generated in the center, and a rising dynamic pressure is generated at the periphery of the moving body.

Referring to FIG. 4C, if the moving body having herringbone-structure grooves is rotated in a counterclockwise direction, the external air from the periphery of the moving body and the central air flow toward the bent portion of grooves. Thus, a rising air-pressure distribution P3 is generated in the bent portion of grooves, whereby a rising dynamic pressure is generated in the bent portion of grooves.

That is, when forming the moving body having the herringbone-structure grooves, the air rises in the bent portion of grooves, thereby generating a negative pressure in the bent portion of grooves. That is, in a state that the grooves of the polishing pad are formed in the herringbone-structure, the polishing pad is rotated in a direction opposite, or perpendicular, to the bent direction of grooves, whereby a rising dynamic pressure is generated in the bent portion of grooves. As a result, it may be possible to prevent the direct contact between the wafer and the polishing pad.

In the meantime, the characteristics of dynamic pressure in the polishing pad having the herringbone-structure grooves can be understood with the change in coefficient of friction (COF). For example, with due regard to a copper CMP process of maintaining a low pressure at a high speed, the following experiment for measuring a COF value may be performed in similar conditions.

FIG. 5 is a view of showing the polishing pad rotated in a direction of 'A' (when rotating the polishing pad in a direction opposite to the bent direction of grooves formed in the herringbone-structure) or 'B' (when rotating the polishing pad in the same direction as the bent direction of grooves formed in the herringbone-structure), consistent with the present invention. When rotating the polishing pad in the direction of 'A', a rising dynamic pressure is generated in the bent direction of grooves. In the meantime, when rotating the polishing pad in the direction of 'B', a dropping dynamic pressure is generated in the bent direction of grooves.

FIG. 6 is a graph of showing the COF value for V/P when the polishing pad is rotated in the direction of 'A' or 'B'. As shown in FIG. 6, the COF value is changed according to the rotation direction.

When rotating the polishing pad in the direction of 'A', the COF value is small. That is, the wafer is floating due to a rising dynamic pressure, whereby the friction between the polishing pad and the wafer is small.

In the meantime, when rotating the polishing pad in the direction of 'B', the COF value is maintained above a constant level, which is higher than the COF value measured when rotating the polishing pad in the direction of 'A'. Thus, a dropping dynamic pressure is generated, whereby the polishing pad is in contact with the wafer, thereby causing friction between the polishing pad and the wafer. Accordingly, the polishing pad is rotated in a direction opposite to the bent direction of grooves, so as to prevent the contact between the polishing pad and the wafer.

The COF value is related with V/P, wherein V/P is measured under conditions of the same pressure P and rotation speed V. That is, 'V' corresponds to a rotation speed of the wafer, and 'P' corresponds to a pressure applied to the wafer. When applying the pressure (P) to the wafer and rotating (V) the wafer to obtain a V/P value above '1', it may be possible to prevent direct contact between the wafer and the polishing pad.

To obtain a V/P value above '1', it is necessary to perform the CMP process by selecting the suitable pressure (P) for wafer and the suitable rotation speed (V) of the wafer from the graph of FIG. 7. In this state, the effects of a mechanical polishing step decrease, and the effects of a chemical polishing step increase, whereby the chemical polishing step functions as the main factor in the polishing process.

This becomes especially important in the case of polishing soft metals such as copper Cu using a CMP process. Thus, it is possible to eliminate the direct contact between the polishing pad and the wafer, and thereby minimize the formation of scratches on the metal.

As mentioned above, the chemical mechanical polishing apparatus consistent with the present invention has the following advantages.

In the chemical mechanical polishing apparatus consistent with the present invention, the herringbone-structure grooves are formed in the polishing pad, thereby generating a rising dynamic pressure in the surface of the polishing pad when rotating the polishing pad. Thus, it may be possible to prevent direct contact between the wafer and the polishing pad when performing the polishing process.

Accordingly, it may further be possible to prevent scratches on the surface of the wafer caused by direct contact between the polishing pad and the wafer.

When performing a CMP process on copper Cu, scratches are generated more frequently because the copper is soft. Since the chemical mechanical polishing apparatus consistent with the present invention can perform only a chemical polishing step without direct contact between the wafer and the polishing pad, it may be possible to planarize the surface of a wafer over-filled with copper Cu without scratches.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for chemically mechanically polishing a mounted substrate comprising:

a polishing pad having herring-bone shaped grooves formed so as to generate a dynamic pressure by rotation of the pad;

a polishing table to which the pad is adhered;

a polishing head moveably positioning the substrate at a first predetermined distance from the pad, the first distance being large enough such that the substrate does not directly contact the pad; and a slurry supplier providing slurry to a surface of the pad.

2. The apparatus of claim 1, further comprising a polishing conditioner provided at a second predetermined distance from the pad.

3. The apparatus of claim 1, wherein the pad comprises a polishing pad having grooves formed so as to maintain the substrate at the predetermined first distance from the polishing pad by the dynamic pressure.

4. The apparatus of claim 1, wherein the grooves comprise a portion bent in a predetermined direction.

5. The apparatus of claim 1, wherein the pad comprises a polishing pad rotatable in a direction opposite to the predetermined direction.

6. The apparatus of claim 1, wherein the grooves have a width ratio Lp/L between 0.22 and 0.5.

7. The apparatus of claim 1, wherein the grooves have a bent angle $\beta$ between 22° and 32°.

8. The apparatus of claim 1, wherein the grooves have a depth D between 50 μm and 410 μm.

9. The apparatus of claim 1, wherein the grooves have a vertical length $\gamma$ between 0.5 mm and 4 mm.

10. The apparatus of claim 1, wherein the head comprises a head which oscillates and rotates the substrate.

11. A chemical mechanical polishing apparatus comprising:

a rotatable polishing pad, having grooves formed in a herringbone structure and having a bent portion bent in a predetermined direction such that a rising dynamic pressure is generated when the pad is rotated;

a polishing table to which the polishing pad is adhered;

a polishing head moveably supporting a mounted wafer such that the wafer is maintained at a predetermined first distance from the pad by the pressure, the first distance being large enough such that the substrate does not directly contact the pad; and a slurry supplier for providing slurry to a surface of the polishing pad.

12. The chemical mechanical polishing apparatus of claim 11, further comprising a polishing conditioner provided at a predetermined second distance from the polishing pad.

13. The chemical mechanical polishing apparatus of claim 11, wherein the pad comprises a polishing pad rotatable in a direction perpendicular to the predetermined direction.

14. The chemical mechanical polishing apparatus of claim 11, wherein the grooves have a groove width ratio Lp/L between 0.22 and 0.5, a bent angle $\beta$ between 22° and 32°, a groove depth D between 50 μm and 410 μm, and a vertical length $\gamma$ between 0.5 mm and 4 mm.

15. The chemical mechanical polishing apparatus of claim 11, wherein the polishing head comprises a head which oscillatingly moves a mounted wafer in a direction perpendicular to the rotation direction of the polishing pad.

16. A method for chemically mechanically polishing a substrate, comprising:

adhering a polishing pad to a polishing table, the pad having grooves which generate a dynamic pressure when rotated;

mounting the substrate on a polishing head;

providing slurry to a surface of the pad; and rotating the pad to generate a dynamic pressure sufficient to maintain the substrate at a predetermined first distance from the pad, the first distance being large enough such that the substrate does not directly contact the pad.

17. The method of claim 16, further comprising:

operating a polishing conditioner at a second predetermined distance from the pad.

18. The method of claim 16, wherein adhering the pad comprises:

adhering a pad having grooves with a herringbone-shaped structure having a bent portion.

19. The method of claim 18, wherein rotating the pad further comprises:

rotating the pad in a direction perpendicular to the direction of the bent portion of the herringbone-shaped grooves.

20. The method of claim 18, wherein the herringbone-shaped grooves have a groove width ration Lp/L between 0.22 and 0.5.

21. The method of claim 18, wherein the herringbone-shaped grooves have a bent angle $\beta$ between 22° and 32°.

22. The method of claim 18, wherein the herringbone-shaped grooves have a groove depth D between 50 μm and 410 μm.

23. The method of claim 18, wherein the herringbone-shaped grooves have a vertical length $\gamma$ between 0.5 mm and 4 mm.

24. The method of claim 16, further comprising:

oscillating and rotating the substrate using the polishing head.

* * * * *